US006383073B1

(12) United States Patent
Nagano

(10) Patent No.: US 6,383,073 B1
(45) Date of Patent: May 7, 2002

(54) GAMING MACHINE

(75) Inventor: Hiroyuki Nagano, Tokyo (JP)

(73) Assignee: Aruze Corporation, Tokyo (JP)

( * ) Notice: Subject to any disclaimer, the term of this patent is extended or adjusted under 35 U.S.C. 154(b) by 0 days.

(21) Appl. No.: 09/411,203

(22) Filed: Oct. 4, 1999

(30) Foreign Application Priority Data

Oct. 5, 1998 (JP) ..... 10-282228

(51) Int. Cl.[7] ..... A63F 9/24

(52) U.S. Cl. ..... 463/20; 463/25; 273/143 R; 273/121 B

(58) Field of Search ..... 463/1, 11–13, 463/16, 20, 25, 30–31, 36; 273/121 B, 143 R, 139, 138.1, 138.2

(56) References Cited

U.S. PATENT DOCUMENTS

| | | | | |
|---|---|---|---|---|
| 2,404,653 A | * | 7/1946 | Plebanek | |
| 4,553,748 A | * | 11/1985 | Allen | |
| 4,624,459 A | | 11/1986 | Kaufman | |
| 5,259,613 A | * | 11/1993 | Marnell | |
| 5,580,055 A | * | 12/1996 | Hagiwara | 273/143 R |
| 5,664,998 A | * | 9/1997 | Seelig | 463/20 |
| 6,213,875 B1 | * | 4/2001 | Suzuki | 273/121 B |

FOREIGN PATENT DOCUMENTS

| | | | |
|---|---|---|---|
| DE | 38 30 648 A1 | | 3/1990 |
| EP | 0 484 085 A2 | | 5/1992 |
| EP | 0 875 870 A2 | | 11/1998 |
| GB | 2062922 | * | 5/1981 |
| GB | 2 174 832 A | | 11/1986 |
| GB | 2191030 | * | 12/1987 |
| GB | 2 326-260 A | | 12/1998 |

OTHER PUBLICATIONS

Shohachi, Sankyo, Patent Abstracts of Japan, "Gaming Machine" Publication No. 06335559, Publication Date Jun. 12, 1994.

Japanese Patent Office, Japanese Patent Publication No. 6–335559 ("Gaming Machine"), Publication Date Jun. 12, 1994, (App. 5–127114, Filed on May 28, 1993), pp. 1–19.

* cited by examiner

*Primary Examiner*—Mark Sager
(74) *Attorney, Agent, or Firm*—Snider & Associates; Ronald R. Snider

(57) ABSTRACT

A gaming machine displays a plurality of rows of symbols in moving and stopped states at an image display section formed in a front panel. If big winning symbols to be displayed in a stopped state are not attained as the result of determination (S4), then random number sampling for deciding whether or not to execute an image action is carried out (S6). According to the result of this sampling, whether or not to execute the image action is determined (S7). If it is determined to execute the image action, then an operation for randomly blinking tricolor-emitting LEDs is carried out at step 8 (S8). The LED display when executing the image action may be at a low luminance, as long as a player can guess, by seeing the blinking of tricolor-emitting LEDs, that a certain phenomenon relating to big winning might be occurring. The blinking pattern of the tricolor-emitting LEDs is constituted by randomly repeating their color changes. Thus performed is an attraction from which the player continuing a game while waiting for a specific winning arrangement can guess a relation to the winning arrangement, thereby multiplying interest in the game and enhancing the amusement.

17 Claims, 11 Drawing Sheets

NORMAL BGM

ON
START BUTTON
OFF

ROTATE
REEL OPERATION
STOP

SOUND FOR IMAGE ACTION (CLARINET OR TRUMPET)

SOUND FOR BIG WINNING (CLARINET)

SOUND FOR BIG WINNING (TRUMPET)

B
A
61
DETEC-
TION
BLOCK
50
CCU
R1
M1
R2
R2
R3
M3
60
SUB CPU
MOTOR
DRIVER
MAIN
CPU
ROM
51
130A – 130I
62
RAM
52
LAMPS
LAMP
DRIVER
70
71
54
53
HOPPER
HOPPER
MOTOR
DRIVER
DIV.
CL.
75
55
56
72
SW
INPUT
SECTION
SOUND
CPU
SOUND
GENE-
RATOR
SP
MEDAL
DETECTOR
78
etc.
76
57
120-126
LOCK SOLENOID
COUNTER
DRIVER
LED
DRI-
VER
77
COUNTER
LAMP
128
128a
79
START SIGNAL
GENERATOR
(START LEVER, etc.)

GAMING MACHINE

RELATED APPLICATIONS

This application claims the priority of Japanese Patent Application No. 10-282228 filed on Oct. 5, 1998, which is incorporated herein by reference.

BACKGROUND OF THE INVENTION

1. Field of the Invention

The present invention relates to a gaming machine, such as slot machine, pachinko machine, or the like, having an apparatus which displays a plurality of rows of symbols in moving and stopped states; and, in particular, to a gaming machine which provides a player with a predetermined reward when the arrangement of the rows of symbols displayed in a stopped state is a particular arrangement which is a predetermined combination of symbols.

2. Description of the Prior Art

Among slot machines and some pachinko machines, there have been known gaming machines equipped with a reel apparatus having a plurality of reels, which stops the rotation of each reel after the lapse of a predetermined period of time from the starting of rotation or in response to a predetermined reel-stopping operation carried out by a player. In general, such a reel apparatus has the following configuration.

Namely, the plurality of reels are independently rotatable around the same axis, each of the reels having a plurality of symbols formed on the peripheral surface thereof in series along its circumferential direction. Upon a player's starting operation, the individual reels start rotating at the same time and, thereafter, sequentially stop such that at least one of the plurality of symbols in each reel aligns with an effective line disposed on display windows in front of the reels.

The symbols displayed on the display windows are determined by random number sampling carried out by a control unit accommodated in the gaming machine.

Namely, at the same time when each game is started or immediately thereafter, the control unit determines whether the play results in "winning" or not by comparing a value acquired by random number sampling with an award table prestored in a memory device. When the determination results in winning, then each reel is displayed in a stopped state such that a combination of symbols constructing a winning display arrangement aligns with the effective line of the display windows. On the other hand, when the determination does not result in winning, each reel is displayed in a stopped state such that a combination of symbols which does not construct any winning display arrangement aligns with the effective line of the display windows.

In the above-mentioned gaming machine, a particular combination of symbols, such as "7-7-7" or the like, called "big winning" which provides the player with a premium reward gain is predetermined in addition to usual winning arrangements. Players of such a gaming machine play games, while hoping for big winning.

Since the probability of attaining such big winning is low, however, there may be cases where the big winning is awaited for a long time. In such a case, the player would repeat a monotonous game for a long time, thus being apt to lose interest in the game.

In particular, so-called auto-stop type slot machines equipped with no stop button have been likely to give the impression that big winning simply occurs when the combination of symbols appearing on the display windows in front of the individual reels incidentally match a particular symbol pattern, thereby being unsatisfactory in terms of amusement.

In gaming machines which repeatedly perform similar games, such as slot machine and the like, the player perceives even a little attraction appearing on the gaming board in front of own eyes, thereby guessing what it means and how it relates to big winning, which would enhance interest in the games.

SUMMARY OF THE INVENTION

In view of such circumstances, it is an object of the present invention to provide a gaming machine performing an attraction from which a player continuing a game while waiting for a specific winning arrangement can guess a relation to the winning arrangement, thereby being able to multiply interest in the game.

The gaming machine in accordance with the present invention is a gaming machine which displays a plurality of rows of symbols in a moving state at an image display section formed in a front panel, stops displaying the rows of symbols in the moving state thereafter, and gives a predetermined reward to a player when an arrangement of symbols displayed in thus stopped state coincides with a particular arrangement which is a predetermined combination of symbols, the gaming machine comprising:

symbol determination apparatus for determining the arrangement of rows of symbols displayed in the stopped state at the image display section before the rows of symbols are displayed in the stopped state; and an image action generator for causing the player to perceive a predetermined image action independently from the determination by the symbol determination apparatus of whether the arrangement displayed in the stopped state is the particular arrangement or not.

Here, "image action" means an attraction irrelevant to whether winning or big winning is attained or not, which is performed for maintaining or multiplying the player's interest in the game.

The gaming machine in accordance with the present invention may further comprise notification apparatus for notifying of a predetermined notification, when the arrangement displayed in the stopped state is determined to be the particular arrangement by the symbol determination apparatus, that the particular arrangement is attained; and the image action generator is configured so as to cause the player to perceive the image action according to an arrangement different from the predetermined notification by using at least a part of the notification apparatus.

In the gaming machine in accordance with the present invention, the image action generator may comprise an LED.

In the gaming machine in accordance with the present invention, the LED may comprise a multicolor-emitting LED.

In the gaming machine in accordance with the present invention, the image action may be constituted by an arrangement different from the predetermined notification in at least one of luminance, lighting timing, and color displaying and color switching timing of the LED.

In the gaming machine in accordance with the present invention, the image action generator may comprise apparatus for outputting a predetermined sound.

In the gaming machine in accordance with the present invention, the image action may be constituted by an arrangement in which at least a part of the sound outputted is different from that in the predetermined notification in at least one of scale, tone, strength, and tempo of the sound.

In the gaming machine in accordance with the present invention, the image action generator may be disposed within or near the front panel.

In the gaming machine in accordance with the present invention, the image action may be constituted by an arrangement different from the predetermined notification.

In the gaming machine in accordance with the present invention, the image action generator comprises an LED.

In the gaming machine in accordance with the present invention, the LED comprises a multicolor-emitting LED.

In the gaming machine in accordance with the present invention, the image action generator comprises apparatus for outputting a predetermined sound.

In the gaming machine in accordance with the present invention, the image action generator is disposed within or near a front panel.

The gaming machine in accordance with the present invention is a gaming machine which displays a plurality of rows of symbols in a moving state at an image display section formed in a front panel, stops displaying the rows of symbols in the moving state thereafter, and gives a predetermined reward to a player when an arrangement of symbols displayed in thus stopped state coincides with a particular arrangement which is a predetermined combination of symbols, the gaming machine comprising:

symbol determination means for determining the arrangement of rows of symbols displayed in the stopped state at the image display section before the rows of symbols are displayed in the stopped state; and image action generating means for causing the player to perceive a predetermined image action independently from the determination by the symbol determination means of whether the arrangement displayed in the stopped state is the particular arrangement or not.

DESCRIPTION OF THE PREFERRED EMBODIMENTS

In the following, the gaming machine in accordance with a first embodiment of the present invention will be explained with reference to the accompanying drawings.

Figure 2:
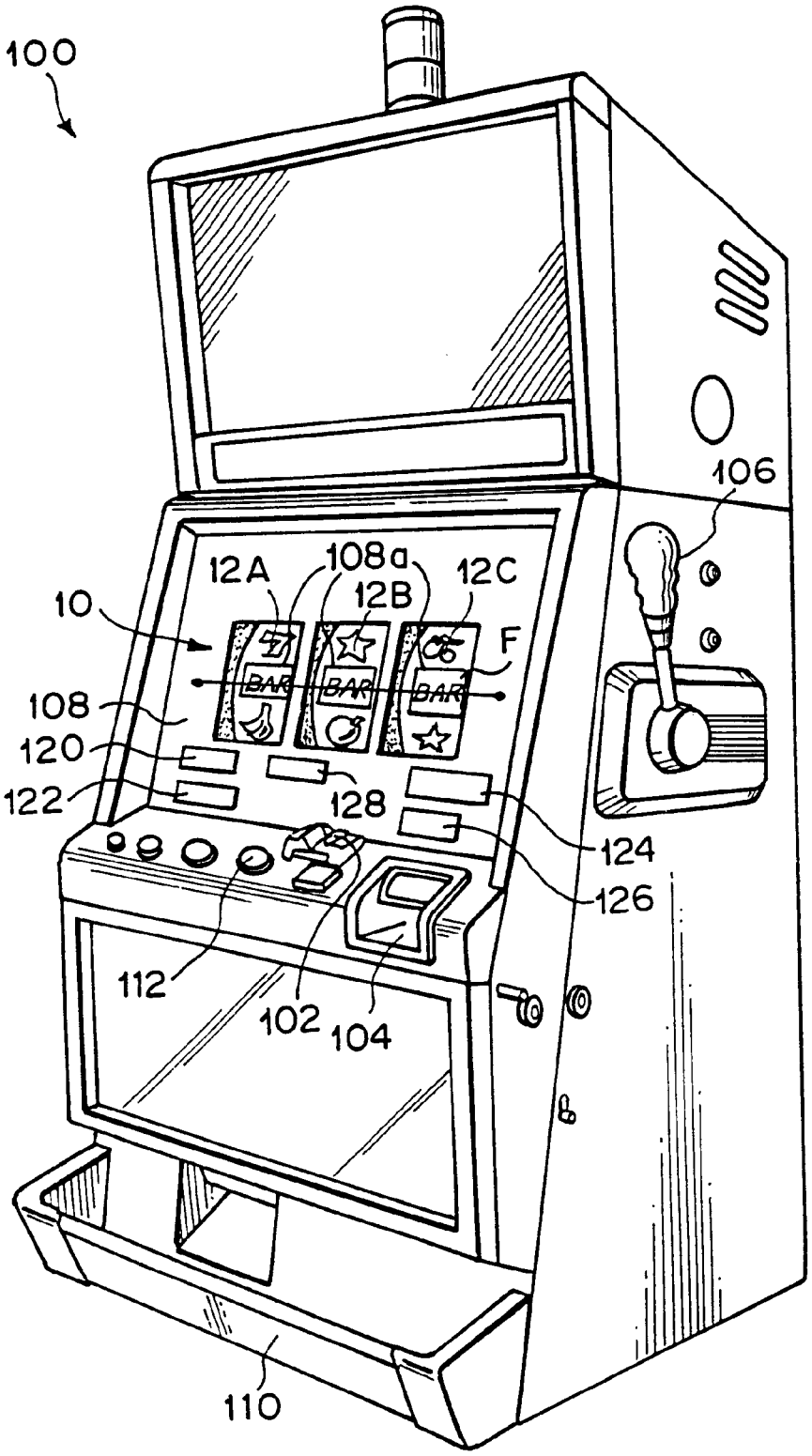
FIG. 2 is a perspective view showing the gaming machine in accordance with any of embodiments of the present invention.

FIG. 2 is a perspective view showing the gaming machine (slot machine) in accordance with this embodiment. As shown in FIG. 2, this slot machine 100 is an auto-stop-reel type slot machine, in which, when a handle lever 106 is pushed down toward the front side (or a start button such as spin button 112 or the like is pressed) with cash being inserted in a coin entry 102 or bill entry 104, a reel apparatus 10 provided with a plurality of symbols F in series is actuated, so that its three reels 12A, 12B, and 12C simultaneously start rotating, and then the left reel 12A, the center reel 12B, and the right reel 12C sequentially stop rotating in this order.

Here, each of the reels 12A, 12B, and 12C stops rotating such that one of the plurality of symbols F aligns with an effective line disposed on three display windows 108*a* formed in a front panel 108.

If the combination of symbols F displayed at the effective line of the three display windows 108*a* when the reels 12A, 12B, and 12C are stopped matches a predetermined winning pattern, then coins will flow out to a coin tray 110 by the number corresponding to the winning pattern. If the combination of symbols F matches a predetermined big winning pattern among winning patterns, then a large number of coins corresponding to the big winning pattern will flow out to the coin tray 110.

In each of the reels 12A, 12B, and 12C, the part formed with the symbols F is made of a semitransparent member exhibiting diffuse transmissivity. Hence, the symbols F located at the display windows 108*a* are brightly illuminated from therebehind by reel section illuminating lamps disposed in the space on the inner periphery side of the reels 12A, 12B, and 12C.

Disposed below the left reel 12A are a bet meter 120 for displaying a bet number by seven segments, and a last bet meter 122 for displaying, by seven segments, the number bet in the last game. Disposed below the right reel 12C are a win meter 124 for displaying, by seven segments, the number of coins acquired until after the last game, and a credit meter 126 for displaying, by seven segments, the remaining number of credit. These meters 120 to 126 are always turned on in a normal game.

Meanwhile, the symbols displayed at the effective line of the display windows 108*a* are determined by random number sampling performed by a control unit accommodated in the gaming machine. At the same time when each game is started or immediately thereafter, the control unit determines whether the play results in winning or not by comparing a value acquired by random number sampling with an award table prestored in a memory device. When the determination results in winning, then each of the reels 12A, 12B, and 12C is displayed in a stopped state such that a combination of symbols F constructing a winning display arrangement aligns with the effective line of the display windows 108*a*.

On the other hand, when the determination does not result in winning, each of the reels 12A, 12B, and 12C is displayed in a stopped state such that a combination of symbols which does not construct any winning display arrangement aligns with the effective line of the display windows 108*a*.

In such a gaming machine, as mentioned above, a particular combination of symbols F, such as "7-7-7" or the like, called "big winning" which provides the player with a premium reward is predetermined in addition to usual winning arrangements. Therefore, the player of the above-mentioned gaming machine plays games, while hoping for big winning.

Immediately after each game is started, the above-mentioned control unit determines whether the play results in winning or not, and causes, when the determination results in winning, each of the reels 12A, 12B, and 12C to be displayed in a stopped state such that a combination of symbols F constructing a winning display arrangement aligns with the effective line of the display windows 108*a*. If the winning is big winning, then an attraction is performed such that the seven segment LEDs of the meters 120 to 126 disposed on the front panel 108 and the reel section illuminating lamps, corresponding to the individual symbols F, disposed in the space on the inner periphery side of the reels 12A, 12B, and 12C are turned on, turned off, or blinked in a particular arrangement during the rotating period of the reels 12A, 12B, and 12C or at a predetermined timing by which they are displayed in a stopped state.

Thus, the player acquiring winning, big winning in particular, can enjoy the impression thereof through various visual attractions such as the one mentioned above.

Nevertheless, since the probability of attaining such big winning is low, there may be cases where the big winning is awaited for several hours. In such a case, the player would repeat a monotonous game for a long time, thus being apt to lose interest in the game. Hence, it is desirable that a certain attraction be performed such that the player can keep interest in the game even in a state of waiting for big winning.

Therefore, in this embodiment, a plurality of tricolor-emitting LEDs visible through an LED display window 128 formed in the front panel 108 perform an attraction from which the player can guess a certain relation to winning or big winning, thereby causing the player to keep interest in the game. Here, the attraction performed by the tricolor-emitting LEDs is irrelevant to whether winning or big winning is actually attained or not, and is just an arrangement of attraction for keeping or multiplying the player's interest in the game.

Operations of a CPU in the gaming machine in accordance with the above-mentioned first embodiment will now be explained with reference to the flowchart shown in FIG. 1.

First, at the beginning of the routine, whether a max bet button or the spin button 112 is pressed (or the handle lever 106 is pushed down) or not is determined (S1). If it is determined "yes" here, then all the reels 12A, 12B, and 12C are displayed in a rotating state (S2). Subsequently, symbols to be displayed in a stopped state are determined by random number sampling, and thus determined symbols are extracted (S3).

Thereafter, it is determined whether thus extracted symbols are big winning symbols or not (S4). If they are big winning symbols, then the driving current for LEDs is enhanced (S5), and the flow proceeds to step 8 (S8). As a consequence, the luminance of the LEDs increases so as to become a high luminance for big winning.

On the other hand, if big winning symbols are not attained as the result of the above-mentioned determination (S4), then random number sampling for deciding whether or not to execute an image action is carried out (S6). According to the result of this sampling, whether or not to execute the image action is determined (S7). Here, the random sampling for determining whether to execute the image action or not is carried out according to random number data different from those for determining the symbols to be displayed in the stopped state.

If it is determined to execute the image action, then the flow directly proceeds to step 8 (S8).

At step 8 (S8), an operation for randomly blinking the tricolor-emitting LEDs is carried out. Though the same blinking pattern is used for both of the cases where big winning symbols are attained and where the image action is executed, the player can clearly distinguish these cases from each other by seeing their blinking actions since the LEDs have a brighter luminance in the former case as mentioned above.

The LED display in the case of executing the image action may be set to a low luminance, as long as the player can guess, by seeing the blinking of tricolor-emitting LEDs, that a certain phenomenon relating to big winning might be occurring.

Here, the blinking pattern of tricolor-emitting LEDs is constituted by randomly repeating their color changes.

When the random blinking operations is thus terminated, then each of the reels 12A, 12B, and 12C is displayed in the stopped state such that the symbols extracted at the above-mentioned step 3 (S3) become symbols displayed in the stopped state (S9).

Subsequently, it is determined whether thus displayed symbols are big winning symbols or not (S10). If they are determined to be big winning, then coins corresponding to the big winning are paid out (S11). If not, then the processing of the main routine is terminated as it is.

Here, if it is determined at step 10 (S10) that the symbols are big winning symbols, then an operation for returning the LED driving current to its original value is carried out at step 12 (S12). Namely, the driving current for the tricolor-emitting LEDs manipulated so as to increase at the above-mentioned step S5 (S5) is returned to its original low current value.

Thus, in this embodiment, the image action of randomly blinking the tricolor-emitting LEDs visible through the LED display window 128 is also carried out when the symbols are determined to be no big winning symbols, whereby the player can pay attention to this attraction during a period between occurrences of big winning as well, thus being able to keep interest in the game by guessing.

Though the tricolor-emitting LEDs are randomly blinked in the above-mentioned embodiment, they may be blinked according to a predetermined rule.

Though each LED device in the above-mentioned tricolor-emitting LEDs is configured to emit three colors, LED devices provided so as to correspond to three primary colors of red, green, and blue, respectively, may be blinked randomly or regularly. Also, other multicolor-emitting LEDs may be used in place of the tricolor-emitting LEDs.

Figure 3:
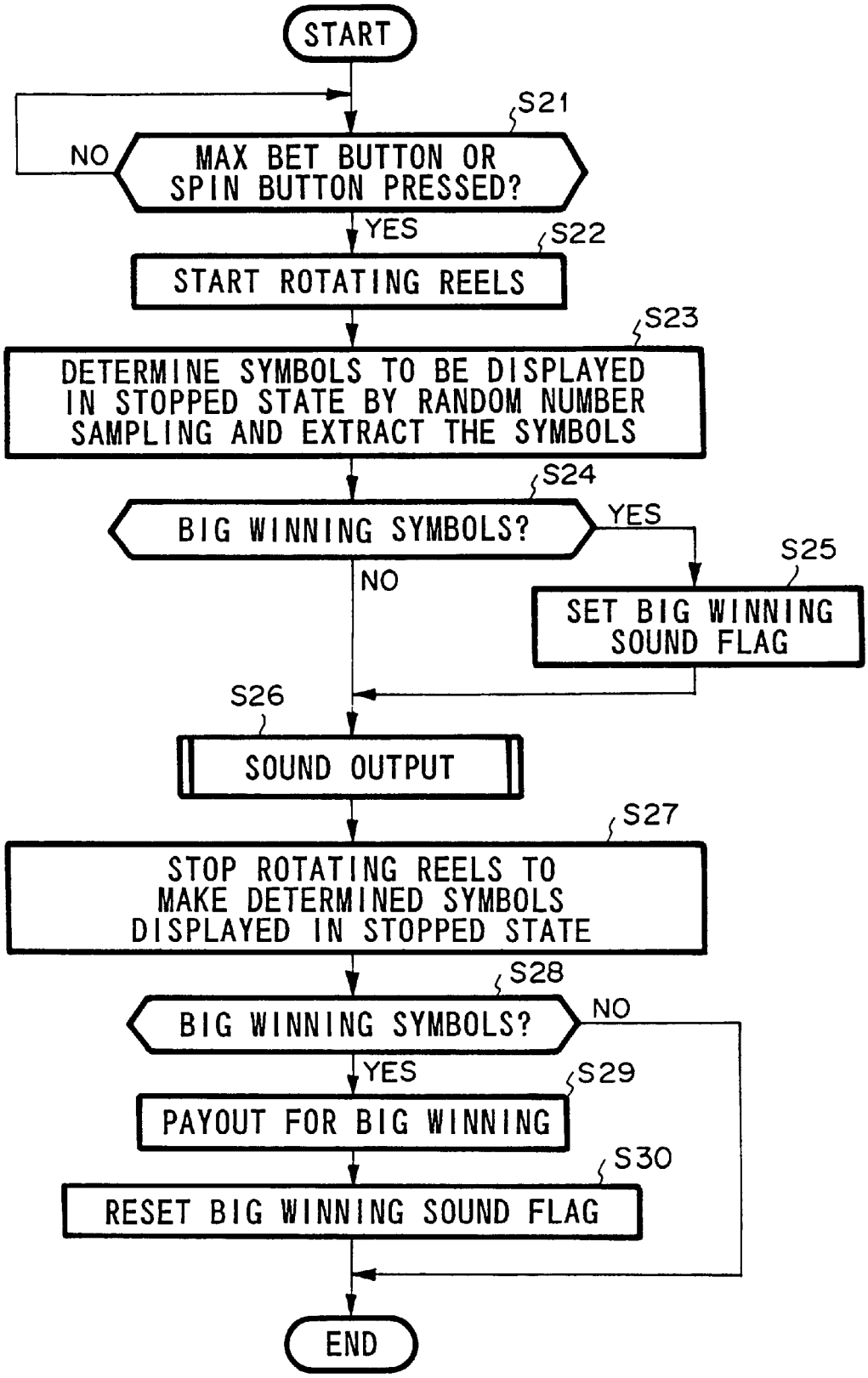
FIG. 3 is a flowchart for explaining an attraction processing operation in the gaming machine in accordance with a second embodiment of the present invention.

Next, CPU operations of the gaming machine in accordance with a second embodiment of the present invention, which carries out an image action by outputting sound, will be explained with reference to the flowchart of FIG. 3.

Namely, in this case, it is initially determined whether the max bet button or the spin button 112 is pressed (or the handle lever 106 is pushed down) or not (S21). If it is determined "yes" here, then all the reels 12A, 12B, and 12C are displayed in a rotating state (S22). Subsequently, symbols to be displayed in a stopped state are determined by random number sampling, and thus determined symbols are extracted (S23).

Thereafter, it is determined whether thus extracted symbols are big winning symbols or not (S24). If they are big winning symbols, then a big winning sound flag is set (S25), and the flow proceeds to step 26 (S26).

On the other hand, if big winning symbols are not attained as the result of the above-mentioned determination (S24), then the flow directly proceeds to step 26 (S26).

At step 26 (S26), a sound output subroutine is executed. The sound output subroutine will be explained later.

When the execution of the sound output subroutine is terminated, then each of the reels 12A, 12B, and 12C is displayed in the stopped state such that the symbols extracted at the above-mentioned step 23 (S23) become symbols displayed in the stopped state (S27).

Subsequently, it is determined whether thus displayed symbols are big winning symbols or not (S28). If they are determined to be big winning, then coins corresponding to the big winning are paid out (S29).

Here, if it is determined at step 28 (S28) that the symbols are big winning symbols, then the big winning flag is reset at step S30 (S30). If it is determined at step 28 (S28) that the symbols are not big winning symbols, on the other hand, then the processing of the main routine is terminated as it is.

Figure 4:
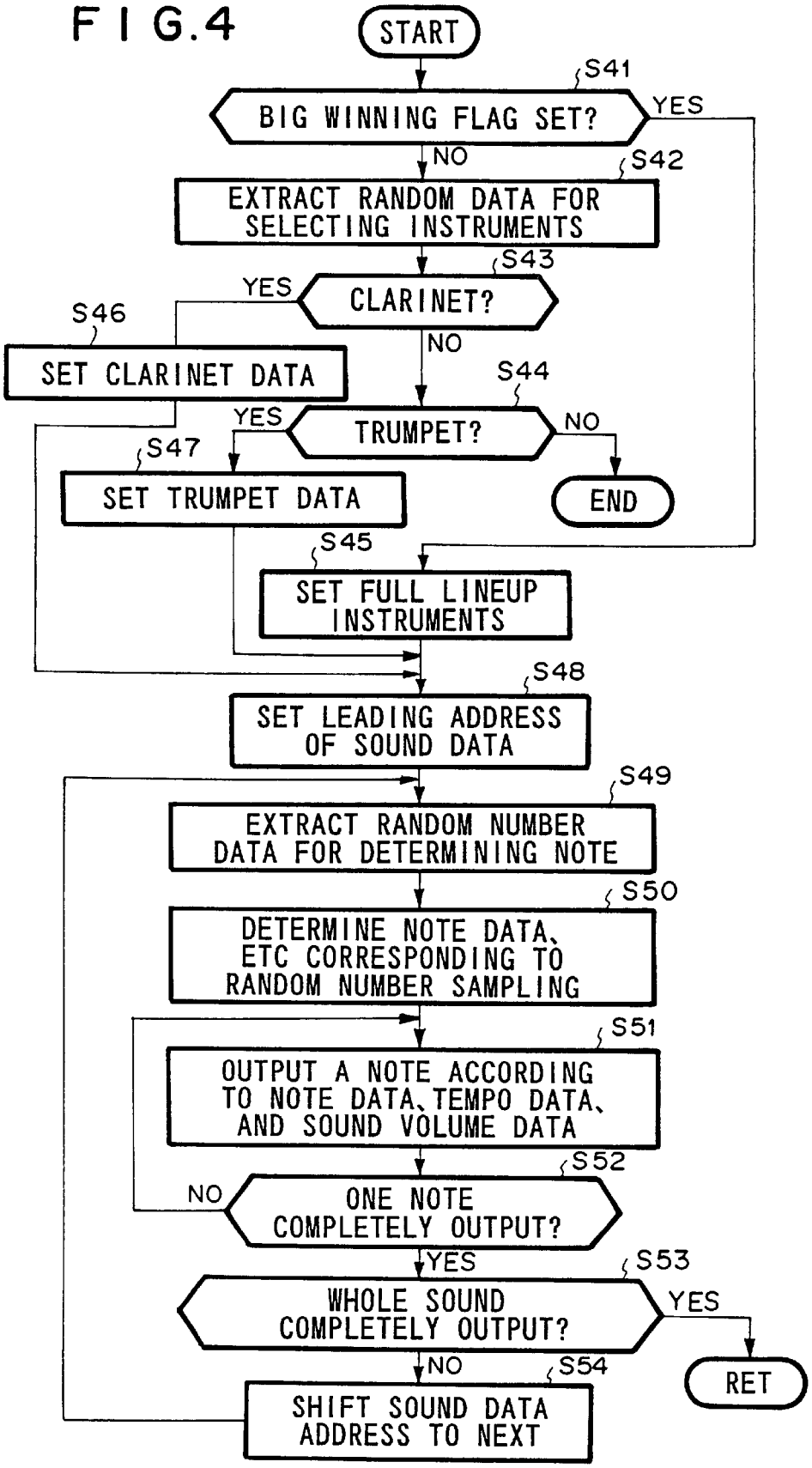
FIG. 4 is a flowchart showing a subroutine processing operation in the flowchart shown in FIG. 3.

Next, the above-mentioned sound output subroutine will be explained with reference to FIG. 4.

First, at step 41 (S41), it is determined whether the big winning flag has already been set or not. If it is determined "yes" here, then the flow proceeds to step 45 (S45), where data for full lineup instruments (e.g., all the instruments usually used in an orchestra) are set.

If the above-mentioned flag has not been set, on the other hand, then random number data for selecting instruments are extracted (S42). Thus extracted random number data are data for selecting a clarinet, a trumpet, or no instrument. Subsequently, at step 43 (S43), it is determined whether the random number data are for the clarinet or not. Also, at step 44 (S44), it is determined whether the random number data are for the trumpet or not. If it is determined that the random number data correspond to any of these instruments, clarinet data setting or trumpet data setting is carried out at step 46 (S46) or step 47 (S47), and the flow proceeds to step 48 (S48). If it is determined that the random number data do not correspond to any of these instruments, i.e., they are data for selecting no instruments, then the subroutine processing operation is terminated, and the flow returns to step 21 (S21) which is the initial operation of the main routine.

The leading address of sound data is set at step 48 (S48). Subsequently, random number data for determining a note are extracted (S49). Note data, tempo data, and sound volume data corresponding to the random number data are determined (S50); and a note according to thus determined note data, tempo data, and sound volume data as well as tone data of the instrument selected as mentioned above is outputted (S51).

Subsequently, the sound output is confirmed note by note (S52), and the address of sound data is successively shifted until the whole sound is outputted (S53, S54). If it is determined that the whole sound is outputted, then the flow returns to the main routine, so as to execute the operation of the above-mentioned step 27 (S27).

Figures 5A, 5B, 5C, 5D, 5E, 5F:
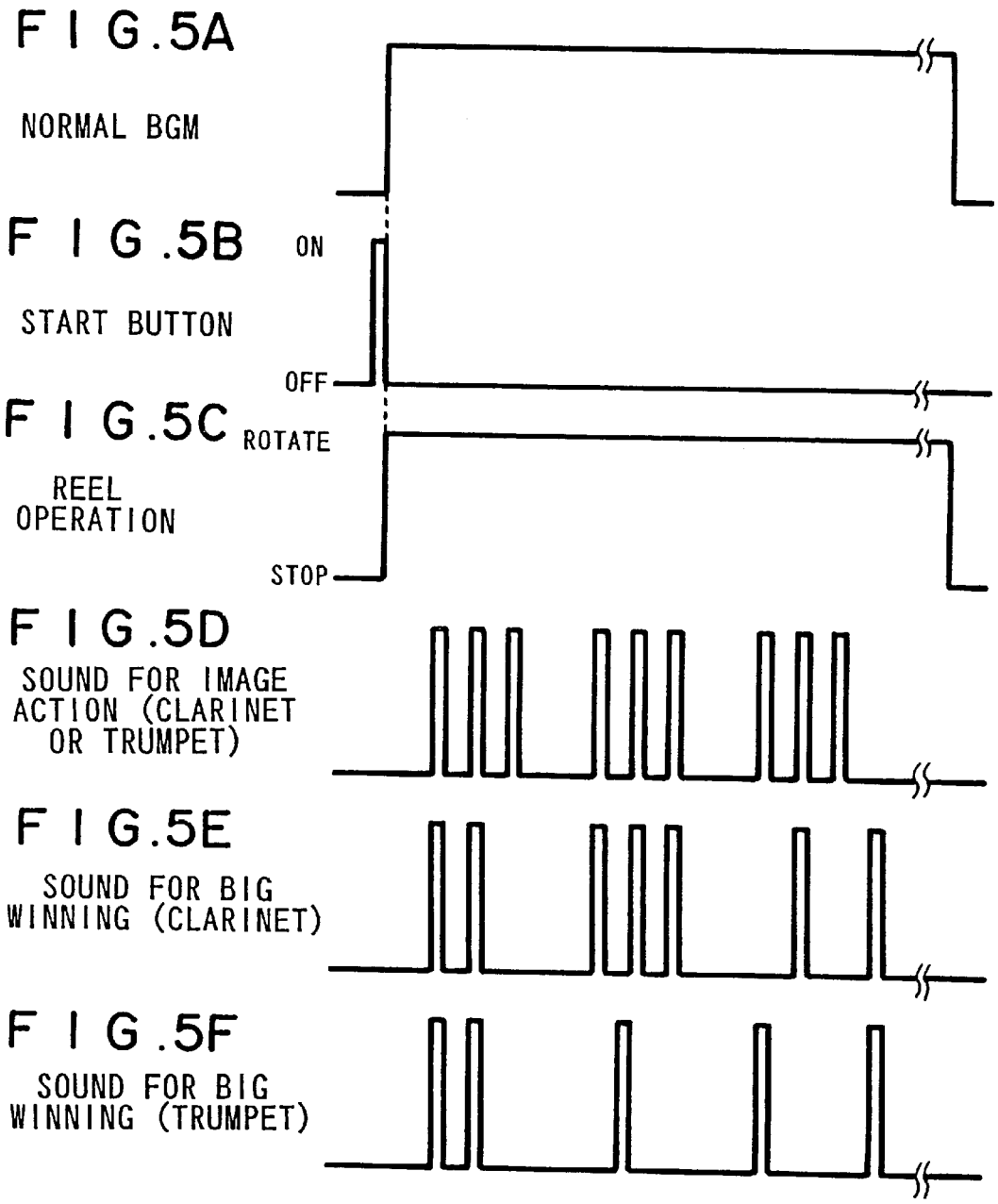
FIGS. 5A to 5F are timing charts for explaining the attraction processing operation in the gaming machine in accordance with the second embodiment of the present invention.

FIGS. 5A to 5F show timing charts of respective operations in accordance with the second embodiment. Namely, when the max bet button or spin button 112 as the start button is pressed (or the handle lever 106 is pushed down), a start signal is outputted in response thereto from the CPU 50, all the reels 12A, 12B, and 12C start rotating in synchronization with the falling timing of the start signal, and normal background music (BGM) is played over a speaker 56 (see FIG. 11) along therewith. In FIG. 5C, the period during which the reel operation is at HIGH level corresponds to a period during which all the reels 12A, 12B, and 12C are rotating.

In the period during which the reel operation is at HIGH level, pulses for the image action (common to the clarinet and trumpet) are outputted, and pulses corresponding to the individual instruments for the big winning sound (only those for the clarinet and trumpet being illustrated here) are outputted.

The output pulses mentioned above with data such as note data, tempo data, sound volume data, and the like being added thereto as mentioned above are outputted as the sound of individual instruments set.

Though the sound output in this embodiment is effected according to similar sound data in both of the cases where big winning symbols are attained and where the image action is executed, the kinds of instruments to play in the former case are 10 or more, for example, thus constituting a full lineup, whereas a single instrument, e.g., clarinet or trumpet, is used in the latter case, whereby the player can clearly distinguish these cases from each other according to the output sound.

The sound output in the case of executing the image action may be a low level, as long as the player can guess, by recognizing the- sound output, that a certain phenomenon relating to big winning might be occurring.

In the following, an apparatus configuration common to the above-mentioned two embodiments will be explained with reference to FIG. 11.

Figure 11:
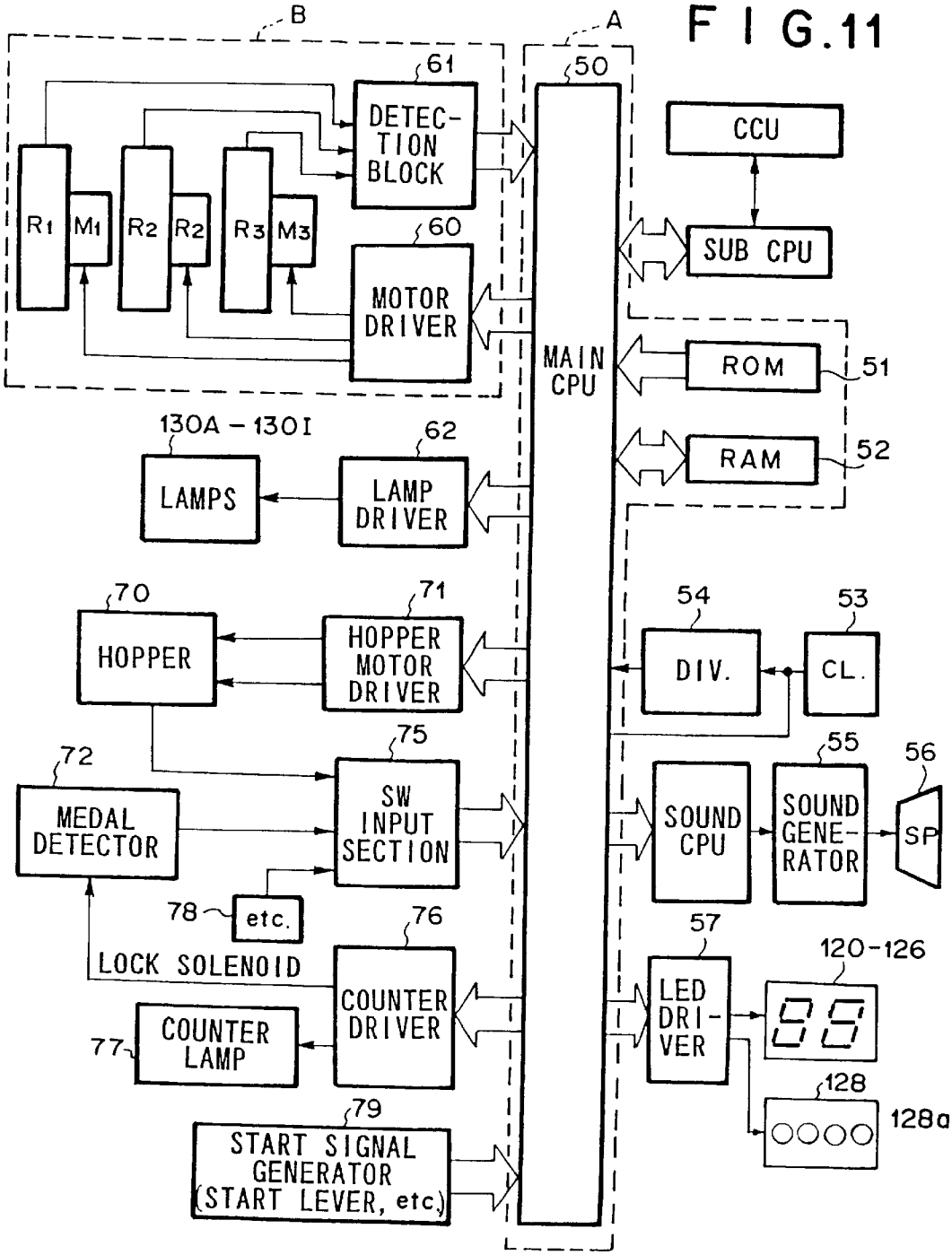
FIG. 11 is a block diagram showing a control unit and the like in the gaming machine in accordance with any of the first and second embodiments.

In FIG. 11, a broken-line block A is a main control section having the main CPU 50, a ROM 51, and a RAM 52. The ROM 51 stores a table of correspondence between symbols F and their symbol codes, a table listing symbol codes corresponding to winning (including big winning) and numbers of winning medals to be paid out, a winning probability table corresponding to winning states used for winning an executed game, a random number table concerning whether to execute the image action or not, random number data for selecting instruments, a table of correspondence between these random number data and the instruments, random data for determining notes, a table of correspondence between the random number data and note data, tempo data, and sound volume data, and the like. On the other hand, the RAM 52 is provided with a random number bank for temporarily saving the value of random number sampled after starting the game, a table for temporarily storing data such as code numbers of the reels and symbol numbers, and the like.

Also provided are a clock pulse generator 53 for generating reference pulses of 4 MHz, for example, at which the main CPU 50 is operated, and a frequency divider 54 for supplying interrupt pulses of 500 MHz, for example, to the main CPU 50 so as to make it execute a predetermined program as an interrupt. Further provided are the above-mentioned speaker 56, and a sound CPU and a sound generator 55 which are driven so as to generate a sound from the speaker 56. Also disposed is an LED driver 57 for driving the individual meters 120 to 126 made of LEDs for displaying seven segments and tricolor-emitting LEDs 128*a* so as to perform the above-mentioned image action.

A broken-line block B refers to a reel driving monitor block. The individual reels R1 (12A), R2 (12B), and R3 (12C) are driven by pulse motors M1, M2, and M3, respectively. The pulse motors Ml, M2, and M3 are rotated by driving pulses supplied from a motor driver 60. For example, the reels R1 (12A), R2 (12B), and R3 (12C) are rotated such that their symbols F seen through the display windows 108*a* shift one by one in response to a predetermined number of pulses. Also, the reels R1 (12A), R2 (12B), and R3 (12C) are configured so as to generate a reset signal per one revolution. A detection block 61 detects this reset signal. After the reset signal is detected by the detection block 61, the main CPU 50 counts the numbers of driving pulses supplied to the pulse motors M1, M2, and M3, whereby the kinds of symbols F seen through the display windows 108*a* can be specified.

Also provided is a lamp driver 62, which drives the reel section illuminating lamps in response to a command from the main CPU 50.

Further provided are a hopper 70 for paying out winning medals and a hopper motor driver 71. Also provided is a medal detector 72 for detecting insertion of medals before starting the game. Together with the payout coin number signal from the hopper 70, the insertion medal number signal from the medal detector 72 is transmitted, via a switch input section 75 and the main CPU 50, to a count driver 76 and further to a counter or lamp 77, whereby the number of inserted medals and the number of payout medals are detected, or the reel section illuminating lamps for the winning effective line are turned on in response to the number of inserted medals. Here, when the number of inserted medals reaches a predetermined number, then a lock solenoid for blocking the medal insertion is driven.

Further provided is another switch operating section 78 such as an abort switch which is operated when the game is to be aborted. Also provided is a start signal generator 79 which is constituted, for example, by the above-mentioned handle lever 106, spin button 112, and the like.

Next, the gaming machine in accordance with a third embodiment of the present invention will be explained with reference to FIGS. 6A to 8. This gaming machine is different from those of the foregoing embodiments in that, in the cases where big winning symbols are attained and where the image action is executed, the attraction is performed not by means of LED or sound but by operating an acting member such as a character model or the like.

Figure 1:
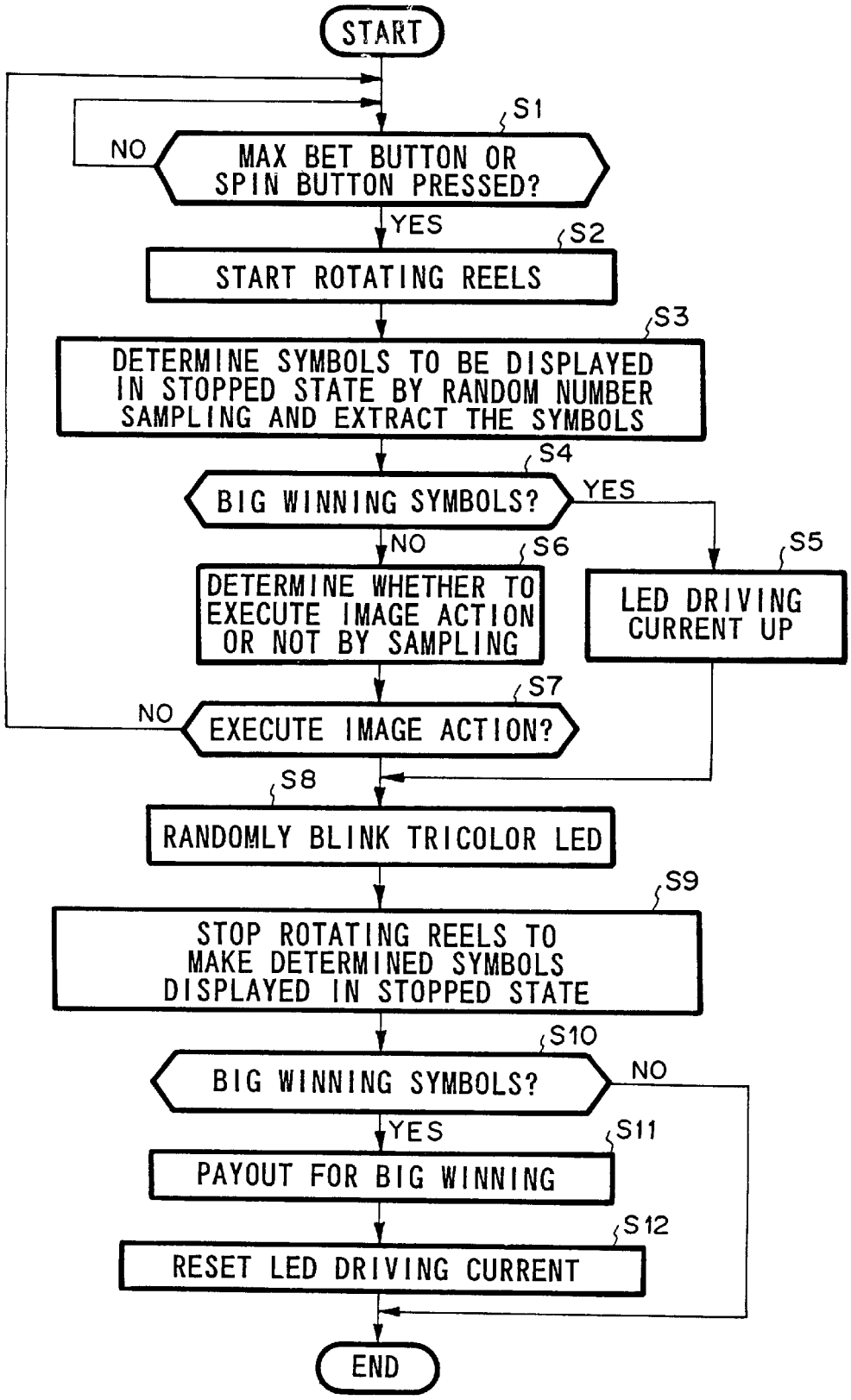
FIG. 1 is a flowchart for explaining an attraction processing operation in the gaming machine in accordance with a first embodiment of the present invention.
Figure 6A:
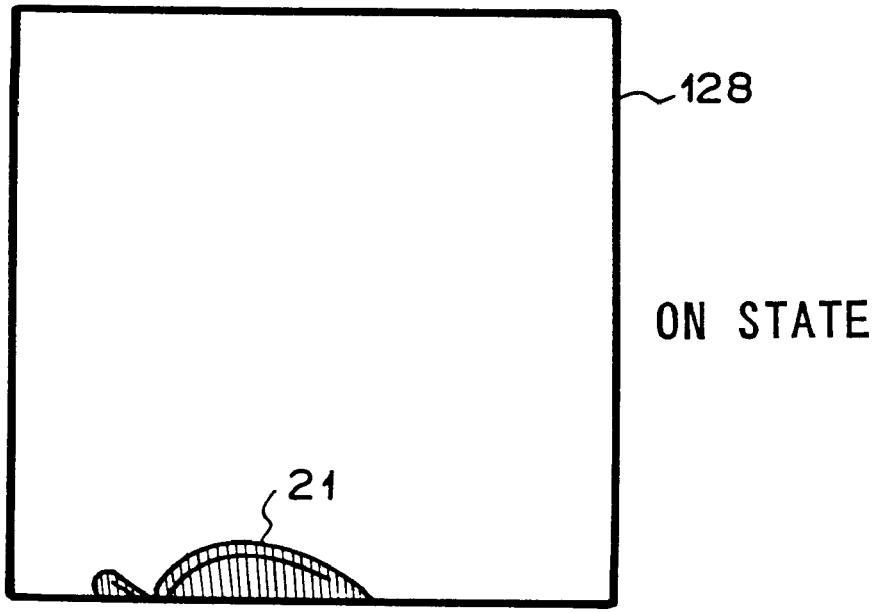
FIGS. 6A and 6B are views for explaining an attraction processing operation in the gaming machine in accordance with a third embodiment of the present invention.
Figure 6B:
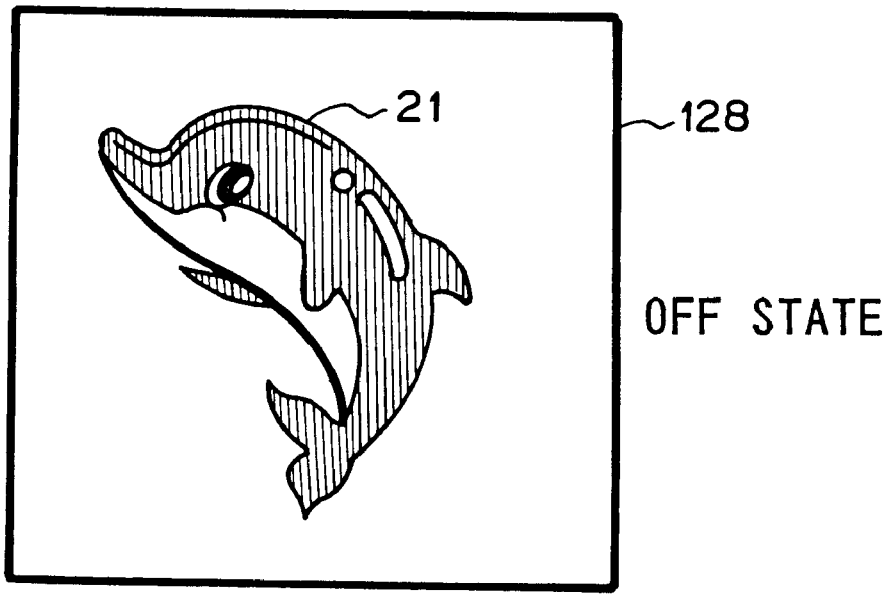

For example, it is configured such that jumping of a dolphin FIG. 21 can be seen through a display window 128 disposed in the front panel 108 of the slot machine 100 shown in FIG. 1, and the dolphin FIG. 21 is operated so as to shift from the state shown in FIG. 6A to the state shown in FIG. 6B and then vice versa.

Figure 7:
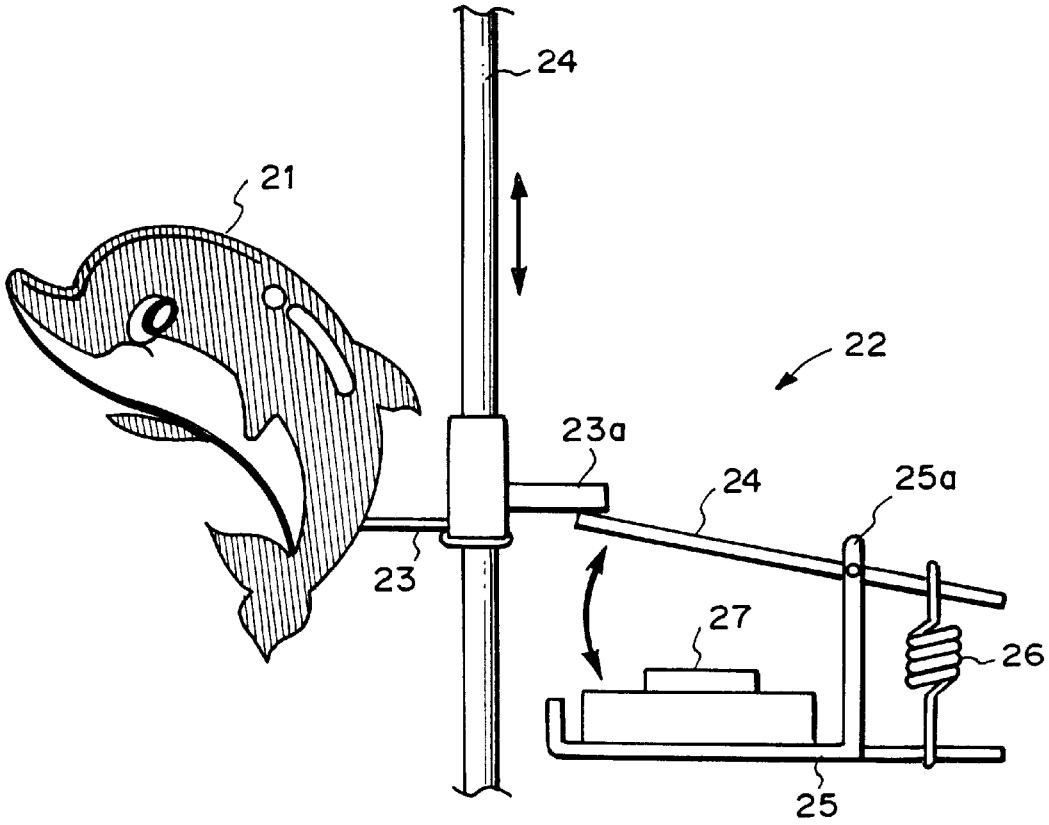
FIG. 7 is a schematic view showing a part of an apparatus for performing the attraction processing operation of the gaming machine in accordance with the third embodiment.

Next, the structure for operating the dolphin FIG. 21 will be explained with reference to FIG. 7. Namely, the dolphin FIG. 21 is held by a dolphin-holding member 23 slidably fitted about a vertically extending support axis 28, and is moved up and down as an iron support rod 24 is moved up and down in response to ON/OFF of an electromagnet 27. When the electromagnet 27 is turned ON, the iron support rod 24 axially supported by an electromagnet holding frame 25 near the upper end 25*a* thereof shifts its left end portion downward against the urging force of a coil spring 26. As a consequence, the dolphin-holding member 23 integrated with a protruded portion 23*a* supported by the iron support rod 24 descends while in the state being fitted about the support axis 28, and the dolphin FIG. 21 moves down together therewith. When the electromagnet 27 is turned OFF, the dolphin FIG. 21 moves up in the reverse manner to the foregoing action in the ON state.

Hence, as the electromagnet 27 is repeatedly turned ON and OFF, the player who can see only the dolphin FIG. 21 through the display window 128 formed with a predetermined size can feel as if the dolphin FIG. 21 is jumping up high in the air.

Figure 8:
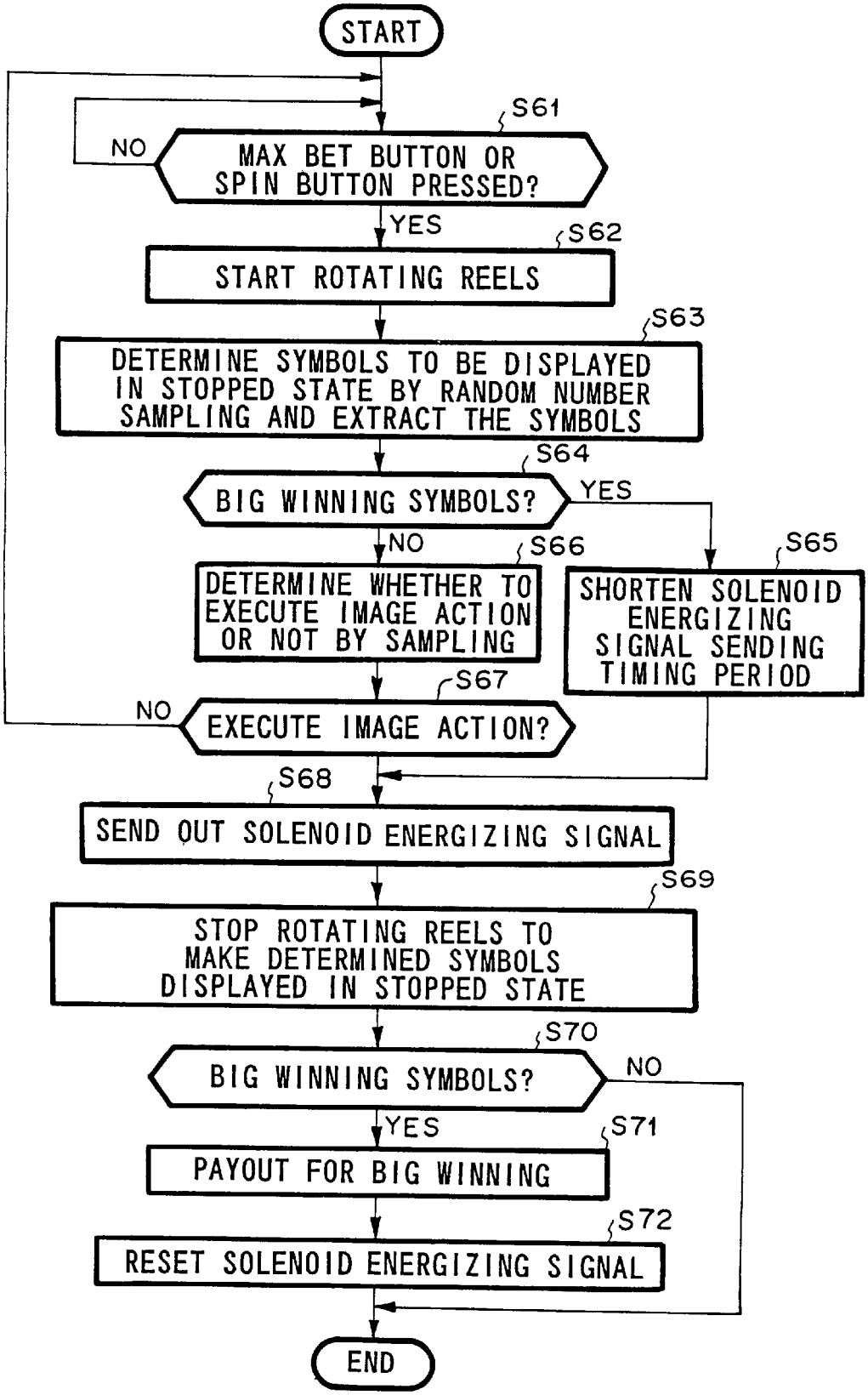
FIG. 8 is a flowchart for explaining the attraction processing operation in the gaming machine in accordance with the third embodiment of the present invention.

Next, CPU operations in the gaming machine in accordance with the above-mentioned third embodiment will be explained with reference to the flowchart shown in FIG. 8.

First, at the beginning of the routine, it is determined whether the max bet button or the spin button 112 is pressed (or the handle lever 106 is pushed down) or not (S61). If it is determined "yes" here, then all the reels 12A, 12B, and 12C are displayed in a rotating state (S62). Subsequently, symbols to be displayed in a stopped state are determined by random number sampling, and thus determined symbols are extracted (S63).

Thereafter, it is determined whether thus extracted symbols are big winning symbols or not (S64). If they are big winning symbols, then the period of the timing for sending out a solenoid energizing signal is set short (S65), and the flow proceeds to step 68 (S68). As a consequence, the dolphin FIG. 21 is set ready for effecting a continuous jumping action for big winning.

On the other hand, if big winning symbols are not attained as the result of the above-mentioned determination (S64), then random number sampling for deciding whether to execute the image action or not is carried out (S66), and whether to execute the image action or not is determined according to the result of sampling (S67).

If it is determined to execute the image action, then the flow directly proceeds to step 68 (S68). If not, the flow returns to step 61 (S61).

At step 68 (S68), an operation for sending out a solenoid energizing signal is carried out. Though an action pattern in which the dolphin FIG. 21 jumps is similarly used in both of the cases where big winning symbols are attained and where the image action is executed, a continuous action is carried out as mentioned above in the former case, whereas an intermittent jumping action in which the dolphin FIG. 21 jumps at intervals is carried out in the latter case, whereby the player can clearly distinguish these cases from each other according to the jumping actions.

When the image action is executed, the dolphin FIG. 21 may jump only once, as long as the player can guess, by seeing the jumping of the dolphin FIG. 21, that a certain phenomenon relating to big winning might be occurring.

The acting member to be seen by the player through the display window 128 is not restricted to character models such as the dolphin FIG. 21, but may have any shape as long as its action can enhance the player's interest.

Figure 9A:
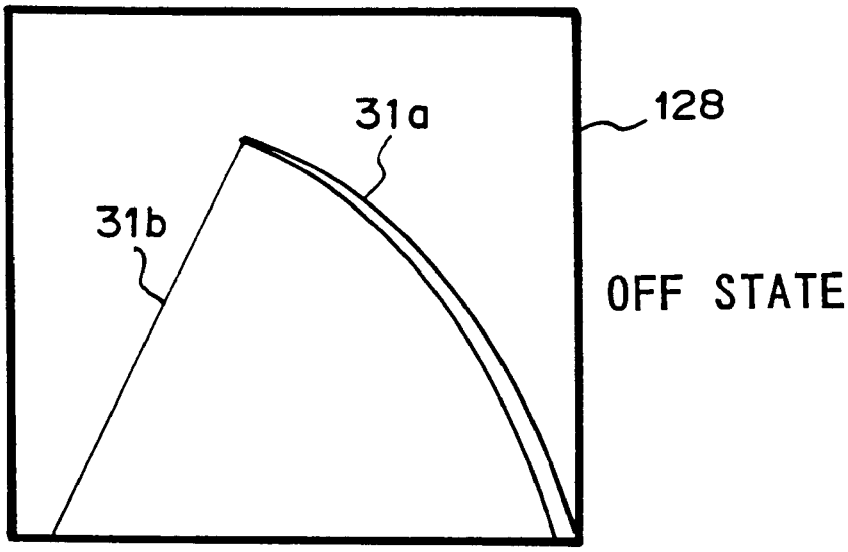
FIGS. 9A and 9B are views for explaining an attraction processing operation in the gaming machine in accordance with a modified example of the third embodiment.
Figure 9B:
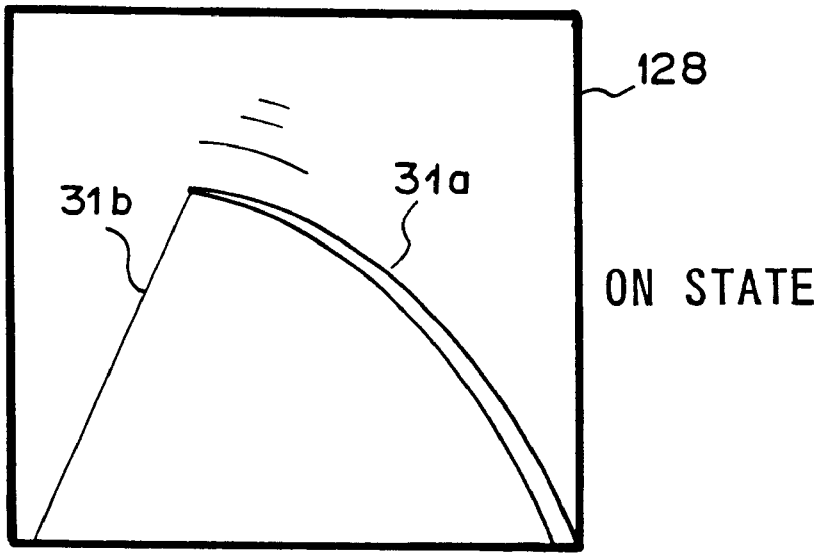

For example, as shown in FIGS. 9A and 9B, a fishing rod 31*a* and a fishing line 31*b* constituting a fishing FIG. 31 may be made visible to the player through the display window 128, and may be operated such that, in the cases where big winning symbols are attained and where the image action is executed, the fishing rod 31*a* is pulled by the fishing line 31*b* so as to bend (shift from the state shown in FIG. 9A to the state shown in FIG. 9B), thereby giving the player an impression as if there is a bite.

Figure 10:
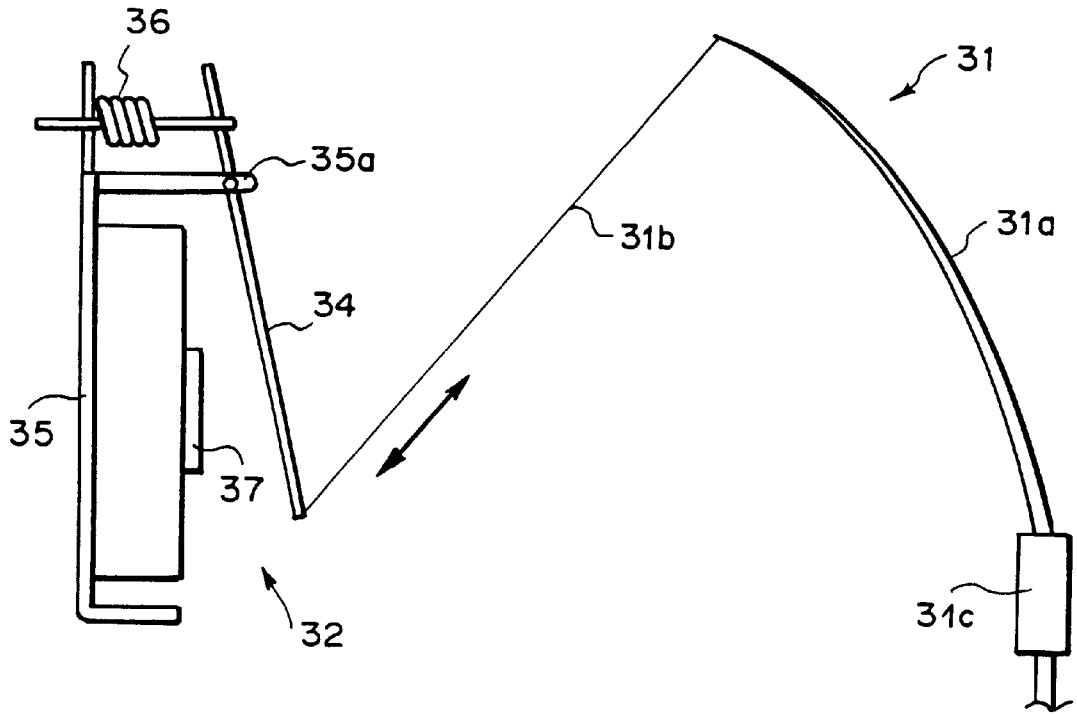
FIG. 10 is a schematic view showing a part of an apparatus for performing the attraction processing operation of the gaming machine in accordance with the modified example of the third embodiment.

The structure for bending the fishing rod 31*a* may be constructed, for example, as shown in FIG. 10. Here, the solenoid section 32 is configured substantially similar to the solenoid section 22 shown in FIG. 7. The iron support rod 34, electromagnet holding frame 35, holding frame upper end portion 35*a*, coil spring 36, and electromagnet 37 in the solenoid section 32 have respective functions similar to those of the iron support rod 24, electromagnet holding frame 25, holding frame upper end portion 25*a*, coil spring 26, and electromagnet 27 in the solenoid section 22, and thus are not explained in detail here.

When the solenoid section 32 is in its OFF state, the lower end portion of the iron support rod 34 is located on the right side, so that the fishing line 31*b* attached to the lower end portion fails to attain the state of pulling the fishing rod 31*a*, whereby the fishing rod 31*a* attains the state of FIG. 9A.

When the solenoid section 32 is in its ON state, on the other hand, the lower end portion of the iron support rod 34 is attracted to the electromagnet 37, so as to shift leftward. As a consequence, the fishing line 31*b* attains the state of pulling the fishing rod 31*a*, whereby the fishing rod 31*a* bends into the state shown in FIG. 9B.

In the state where big winning symbols are attained, the ON and OFF states are repeated in short cycles with the ratio of the period during which the solenoid energizing signal is outputted (ON state) being made greater. As a consequence, the player can see the state where the fishing rod 31*a* vibrates vertically, thereby being able to inflate the image of big winning in the slot machine in view of the bite in fishing, thus making it possible to enhance the expectation for big winning.

When the image action is executed, on the other hand, the ON and OFF states are repeated in long cycles with the ratio of the period during which the solenoid energizing signal is outputted (ON state) being made smaller. In this case, the ON state period of the solenoid energizing signal is such that it ends before the iron support rod 34 is completely attracted to the electromagnet 37, i.e., such a period that the fishing rod 31*a* is pulled a little so as to allow the tip thereof to move just a little.

As a consequence, the player feels as if fish is biting a bait, thus guessing a relation to big winning in the slot machine during the game, thereby being able to enhance interest in the game during the period between actual occurrences of big winning.

In FIG. 10, a fastening member 31*c* for securing the flexible fishing rod 31*a* to the housing of the apparatus is disposed below the fishing rod 31*a*.

CPU operations in the case where the fishing FIG. 31 is used for performing an attraction are substantially the same as those in the case where the dolphin FIG. 21 is used therefor, except that their timings for sending out the solenoid energizing signal differ from each other.

Also, the apparatus configuration in the third embodiment is substantially the same as that of each of the foregoing embodiments explained with reference to FIG. 11.

Though the above-mentioned third embodiment is configured such that the action of the acting member can be seen through the display window 128 of the front panel 108, the acting member may be disposed at other positions which can be seen by the player. For example, the acting member may be disposed inside any of the display windows 108*a* through which the respective reels 12A, 12B, and 12C can be seen, so that the action of the acting member is seen by the player through the display windows 108*a*.

Though the image action generating means in the foregoing embodiments also functions as notification means for notifying, when the symbols displayed in the stopped state are a particular arrangement, that the particular arrangement is attained, these means may be constituted separately from each other as well.

Also, the image action may be performed during either a period in which all the reels are rotating or a period in which a part of the reels is rotating.

Though the above-mentioned first embodiment distinguishes the case of the image action and the case of big winning from each other by changing the luminance of LEDs, their arrangements may be changed in at least one of the LED blinking timing and color displaying and color changing timing, so as to distinguish these cases from each other.

Though the above-mentioned second embodiment distinguishes the case of the image action and the case of big winning from each other by changing the tone of the sound (kind of instrument) outputted from the sound output means, the arrangement of at least a part of the sound outputted from, the sound output means may be changed in at least one of scale, tone, strength, and tempo of the sound, so as to distinguish these cases from each other.

Further, as a specific embodiment, the gaming machine in accordance with the present invention may be configured to include so-called small winning, as a matter of course.

Though the gaming machine in accordance with the present invention is particularly effective when applied to so-called auto-stop type slot machines, it is also applicable to other gaming machines, such as slot machines and pachinko machines, of a type in which the player can manipulate the timing for stopping the rotation of each reel, as a matter of course.

The gaming machine in accordance with the present invention causes the player to perceive a predetermined image action independently from the determination by the symbol determination means of whether the arrangement displayed in the stopped state is a particular arrangement or not, thus being able to perform an attraction from which the player continuing a game while waiting for a specific winning arrangement can guess a relation to the winning arrangement, thereby being capable of multiplying interest in the game.

Also, as the arrangement of generating the image action, any of various arrangements in which a visual attraction is performed by use of LED, an audio attraction is performed by use of sound, an attraction is performed by operating an acting member, and the like can be employed, and can multiply the player's interest in the game.

What is claimed is:

1. A gaming machine which displays a plurality of rows of symbols in a moving state at an image display section formed in a front panel, stops displaying said rows of symbols in the moving state thereafter, and gives a predetermined reward to a player when an arrangement of symbols displayed in thus stopped state coincides with a particular arrangement which is a predetermined combination of symbols, said gaming machine comprising:

symbol determination apparatus for determining the arrangement of rows of symbols displayed in the stopped state at said image display section before said rows of symbols are displayed in the stopped state;

an image action generator for causing said player to perceive a first predetermined image action independently from the determination by said symbol determination apparatus when said arrangement displayed in the stopped state is not said particular arrangement and wherein said image action generator causes said player to perceive a second predetermined action when the reward to the player coincides with the particular arrangement.

2. A gaming machine according to claim 1, further comprising notification apparatus for notifying of a predetermined notification, when said arrangement displayed in the stopped state is determined to be said particular arrangement by said symbol determination apparatus, that said particular arrangement is attained; and whereby said image action generator is configured so as to cause said player to perceive said image action according to an arrangement different from said predetermined notification by using at least a part of said notification apparatus.

3. A gaming machine according to claim 2, wherein said image action generator comprises an LED.

4. A gaming machine according to claim 3, wherein said LED comprises a multicolor-emitting LED.

5. A gaming machine according to claim 3, wherein said image action is constituted by an arrangement different from said predetermined notification in at least one of luminance, lighting timing, and color displaying and color switching timing of said LED.

6. A gaming machine according to claim 5, wherein said LED comprises a multicolor-emitting LED.

7. A gaming machine according to claim 2, wherein said image action generator comprises apparatus for outputting a predetermined sound.

8. A gaming machine according to claim 7, wherein said image action is constituted by an arrangement in which at least a part of sound outputted is different from that in said predetermined notification in at least one of scale, tone, strength, and tempo of said sound.

9. A gaming machine according to claim 2, wherein said image action generator is disposed within or near said front panel.

10. A gaming machine according to claim 9, wherein said image action is constituted by an arrangement different from said predetermined notification.

11. A gaming machine according to claim 1, wherein said image action generator comprises an LED.

12. A gaming machine according to claim 11, wherein said LED comprises a multicolor-emitting LED.

13. A gaming machine according to claim 1, wherein said image action generator comprises apparatus for outputting a predetermined sound.

14. A gaming machine according to claim 1, wherein said image action generator is disposed within or near a front panel.

15. A gaming machine according to claim 1, wherein an increased current causes said second predetermined action.

16. A gaming machine according to claim 15, further comprising apparatus for increasing driving current to the image action generator.

17. A gaming machine which displays a plurality of rows of symbols in a moving state at an image display section formed in a front panel, stops displaying said rows of symbols in the moving state thereafter, and gives a predetermined reward to a player when an arrangement of symbols displayed in thus stopped state coincides with a particular arrangement which is a predetermined combination of symbols, said gaming machine comprising:

symbol determination means for determining the arrangement of rows of symbols displayed in the stopped state at said image display section before said rows of symbols are displayed in the stopped state;

an image action generating means for causing said player to perceive a predetermined image action independently from the determination by said symbol determination means of whether said arrangement displayed in the stopped state is said particular arrangement or not; and wherein said image action generating means causes said player to perceive a second predetermined action when the reward to the player coincides with the particular arrangement.

* * * * *